US008347451B2

(12) United States Patent
Chen

(10) Patent No.: US 8,347,451 B2
(45) Date of Patent: Jan. 8, 2013

(54) FREE-OF-BEARING ROTATIONAL POSITIONING DEVICE FOR A DEWATERING BASKET OF A NON-TREADING TYPE WRINGER BUCKET

(75) Inventor: Yung-Hua Chen, Taipei County (TW)

(73) Assignee: Tuo Shen International Corporation Limited, Taoyuan County (TW)

( * ) Notice: Subject to any disclaimer, the term of this patent is extended or adjusted under 35 U.S.C. 154(b) by 595 days.

(21) Appl. No.: 12/688,128

(22) Filed: Jan. 15, 2010

(65) Prior Publication Data

US 2011/0173770 A1 Jul. 21, 2011

(51) Int. Cl.
*A47L 13/58* (2006.01)

(52) U.S. Cl. ..... 15/260; 34/58; 384/226; 384/242; 384/903

(58) Field of Classification Search ..... 15/257.01, 15/260, 263, 264; 34/58; 68/23 R, 23.3, 68/241; 384/226, 242, 903
See application file for complete search history.

(56) References Cited

U.S. PATENT DOCUMENTS

2011/0000046 A1* 1/2011 Chen et al. ..... 15/260
2011/0088193 A1* 4/2011 Chen et al. ..... 15/260

* cited by examiner

*Primary Examiner* — Mark Spisich
(74) *Attorney, Agent, or Firm* — Rosenberg, Klein & Lee

(57) ABSTRACT

A free-of-bearing rotational positioning device for a dewatering basket of a non-treading type wringer bucket, comprising: a bucket body having a projecting seat being extended from the bottom of the bucket body toward inside; a support shaft being covered and secured by the projecting seat, the upper portion thereof jutting out of the top of the projecting seat to create a connection part; a positioning element having a conic part at the top thereof, the conic part being tapered upward, a positioning surface being formed at the bottom of the conic part and extended outward from the periphery of the support shaft; and a dewatering basket having a driven seat at the center of the bottom thereof. The bottom of the driven seat includes a shaft holder made of non-metal material. In mounting the dewatering basket, the driven seat fits from top to bottom over the connection part of the support shaft. After the lower sleeve passes through positioning element in a compression manner, the positioning surface of the positioning element is stretched into the engagement groove at the center of the shaft holder when returning to its original shape.

10 Claims, 11 Drawing Sheets

FREE-OF-BEARING ROTATIONAL POSITIONING DEVICE FOR A DEWATERING BASKET OF A NON-TREADING TYPE WRINGER BUCKET

BACKGROUND OF THE INVENTION

1. Field of the Invention

The invention relates to a wringer bucket, and more particularly to a wringer bucket that ensures the safety in use since the treading action is not necessary for the operation thereof. Moreover, the dewatering basket does not require a bearing and won't be loosened after a DIY-assembly (do-it-yourself).

2. Description of the Related Art

Mop is one of the cleaning tools used for cleaning a floor, and traditional wringer buckets are used for removing extra water from the mop, and the traditional wringer buckets generally squeeze fabrics of the mop to remove water on the mop fabrics. As disclosed in R.O.C. Pat. No. M338634, a wringer bucket includes a casing, an installing portion, and a rotating unit, wherein the rotating unit includes a retaining element, an axle, a transmission unit and a push rod unit, such that interactions between the aforementioned components drive the rotating unit to rotate to dewater the mop.

However, the aforementioned conventional wringer bucket requires many components in the rotating unit, and thus results in a complicated structure with too many components and shortens the using life of the wringer bucket.

Furthermore, the design of such wringer bucket not only has the disadvantages of a complicated structure and an uneasy installation, but also require users to stand with one foot and step a pail pedal of the wringer bucket by another foot, such that the users may loss balance, fall down or get hurt.

When such wringer buckets are shipped out from a factory, internal components of the wringer buckets are assembled completely, and thus the wringer buckets cannot be transported by a stacking method, and manufacturers have to transport the wringer buckets with a large volume. As the result, a higher transportation cost will be incurred, which is unfavorable to both manufacturers and consumers.

In addition, the conventional wringer bucket includes a rotatable dewatering basket to dewater the mop yarn placed therein. In order to achieve a smooth rotation of the dewatering basket, a bearing available in the market is employed. However, the bearing is easily attacked due to the fact that it is often wetted in the wringer bucket, thereby reducing the service life. Moreover, the dewatering basket is not easy to assemble and disassemble. Therefore, it requires further improvements.

SUMMARY OF THE INVENTION

An object of the invention is to provide a non-treading type wringer bucket that ensures the safety in use since the treading action is not necessary for the operation thereof. Moreover, the dewatering basket won't be loosened after an easy DIY-assembly (do-it-yourself).

Another object of the invention is to provide a wringer bucket having a simple structure and low production cost. The dewatering basket does not require a bearing while a smooth operation is still ensured for a long service life.

A further object of the invention is to provide a wringer bucket that may be stacked on each other for a convenient storage and transportation. Accordingly, less space will be occupied and the freight is considerably reduced.

In order to achieve the above-mentioned objects, the invention includes:

a) a bucket body having an opening at the top thereof, a projecting seat being extended from the bottom of the bucket body toward inside;

b) a support shaft made of metal material, the lower portion of the support shaft being covered and secured by the projecting seat, the upper portion thereof jutting out of the top of the projecting seat to create a connection part, a recessed part being formed at the center of the connection part;

c) a positioning element made of elastic/flexible material, the main body of the positioning element having a conic part at the top thereof, the conic part being tapered upward, the center of the positioning element having a shaft hole with an internal diameter corresponding to the external diameter of the recessed part such that the positioning element fits into the recessed part of the support shaft, a positioning surface being formed at the bottom of the conic part and extended outward from the periphery of the support shaft; and d) a dewatering basket formed by a plastic injection molding process and having a plurality of dewatering holes at the periphery and the bottom thereof, the dewatering basket further having a driven seat at the center of the bottom thereof, wherein, during the formation of the driven seat, the center of the bottom of the driven seat encloses a shaft holder with an opening directed downward and made of non-metal material, and the shaft holder consists of a lower sleeve and an upper sleeve engaging into the lower sleeve, and an engagement groove having a larger diameter is formed within the central portion of the shaft holder, and an end stop is positioned within the top of the upper sleeve, whereby the driven seat tends to slip from top to bottom over the connection part of the support shaft, and after the lower sleeve passes through positioning element in a compression manner, the positioning surface of the positioning element is stretched into the engagement groove when returning to its original shape; in this way, the dewatering basket can be protected from loosening from the support shaft when rotated thereon; moreover, the end stop of the upper sleeve lies against the top portion of the support shaft, thus creating a rotating center; thus, the whole contact point of the dewatering basket is concentrated at the rotating center, thereby reducing the frictional resistance between the shaft holder and the support shaft and therefore permitting a smooth rotation.

The non-stepping wringer bucket of the present invention does not come with an active driving device, but makes use of the rotation of a mop to dewater the mop.

The non-stepping wringer bucket of the present invention further comprises a handle for facilitating users to carry the wringer bucket, and the bucket body has an opening substantially in an ∞ shape, and a convex cambered surface protruded from the bottom of the bucket body for enhancing a support force of the bucket body, such that when the rotating element is rotated, the non-stepping wringer bucket will not be shaken.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
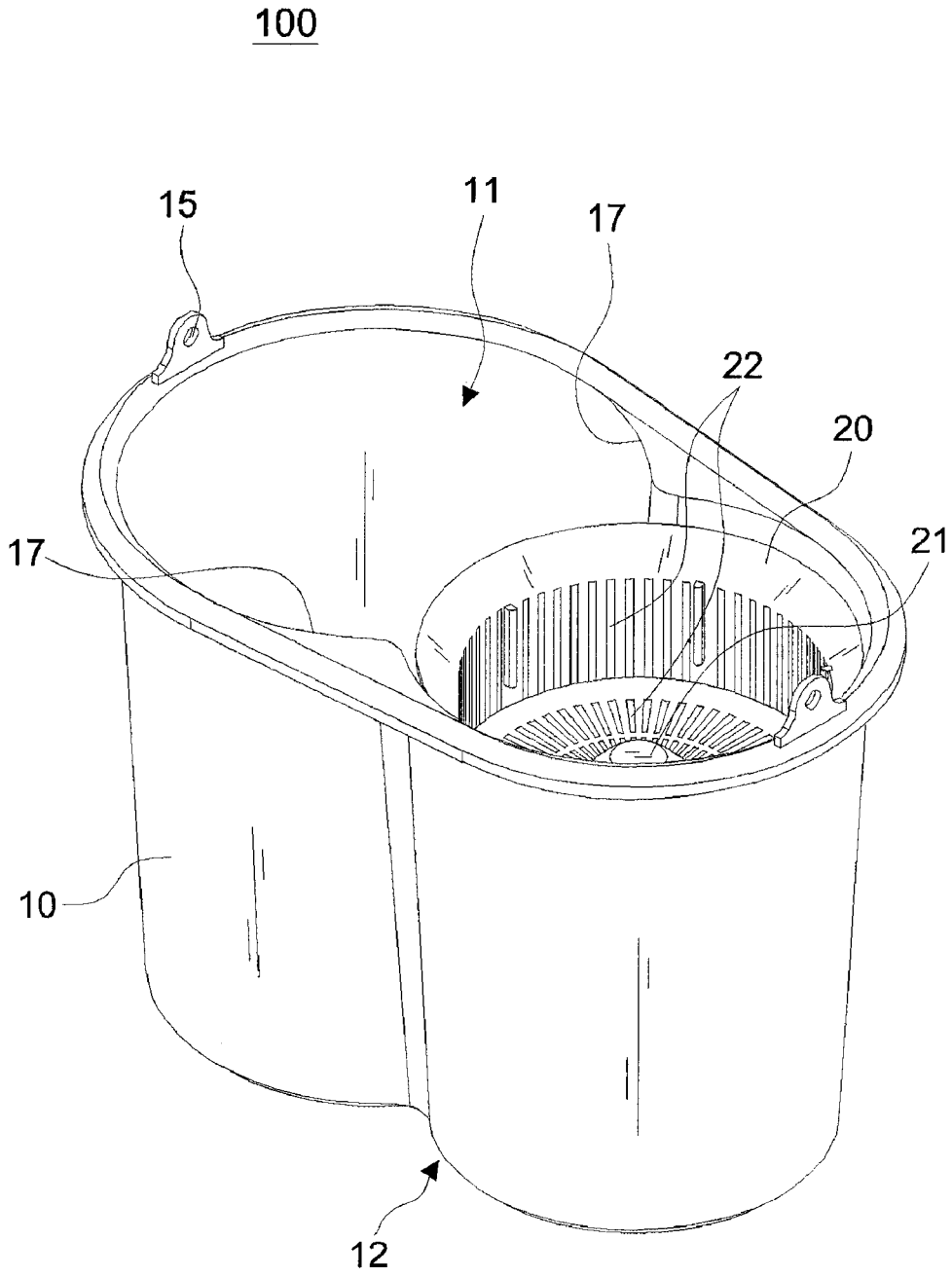
FIG. 1 is a perspective view of a wringer bucket in accordance with the invention.
Figure 2:
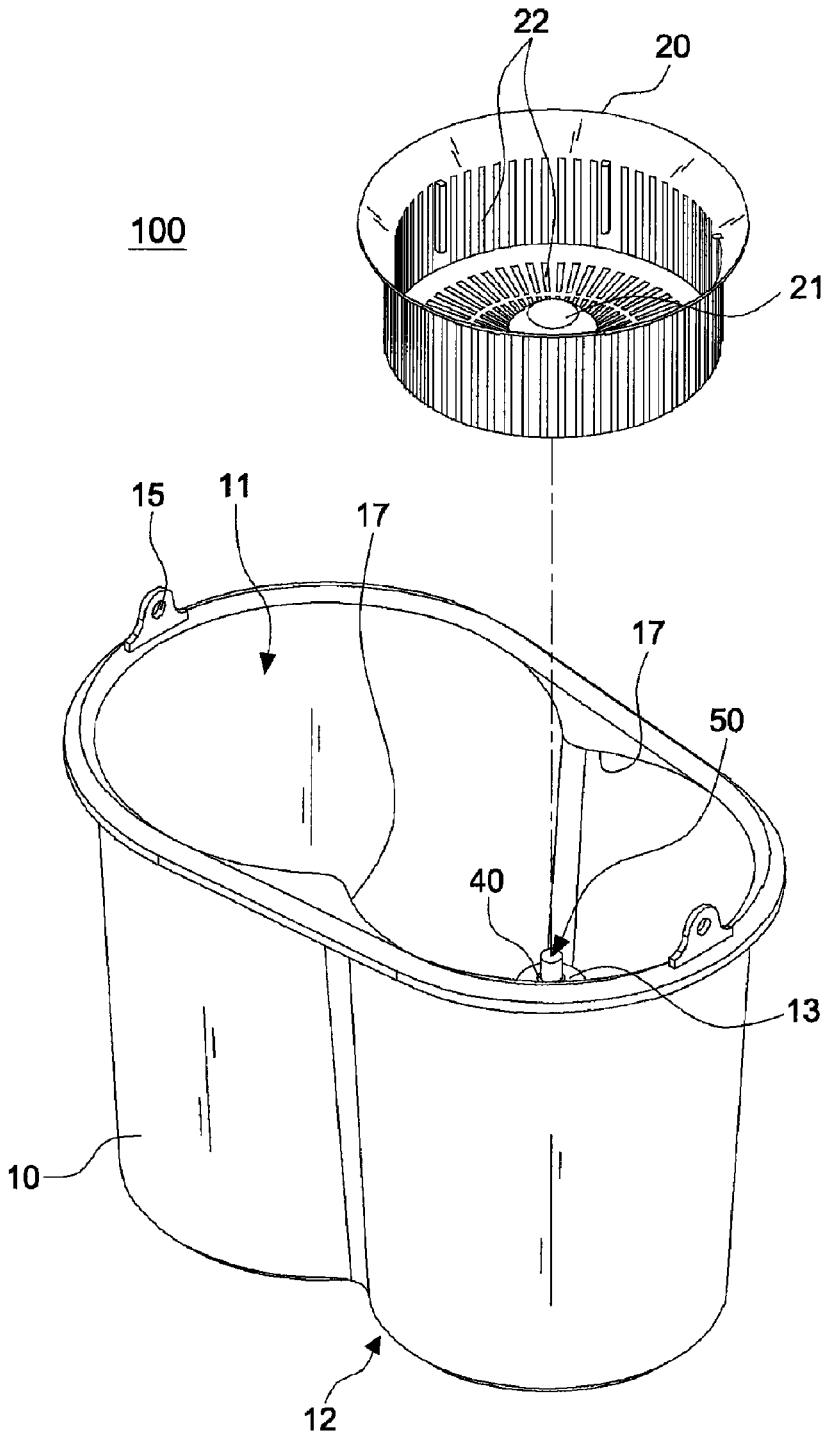
FIG. 2 is an exploded perspective view of the wringer bucket in accordance with the invention.
Figure 3A:
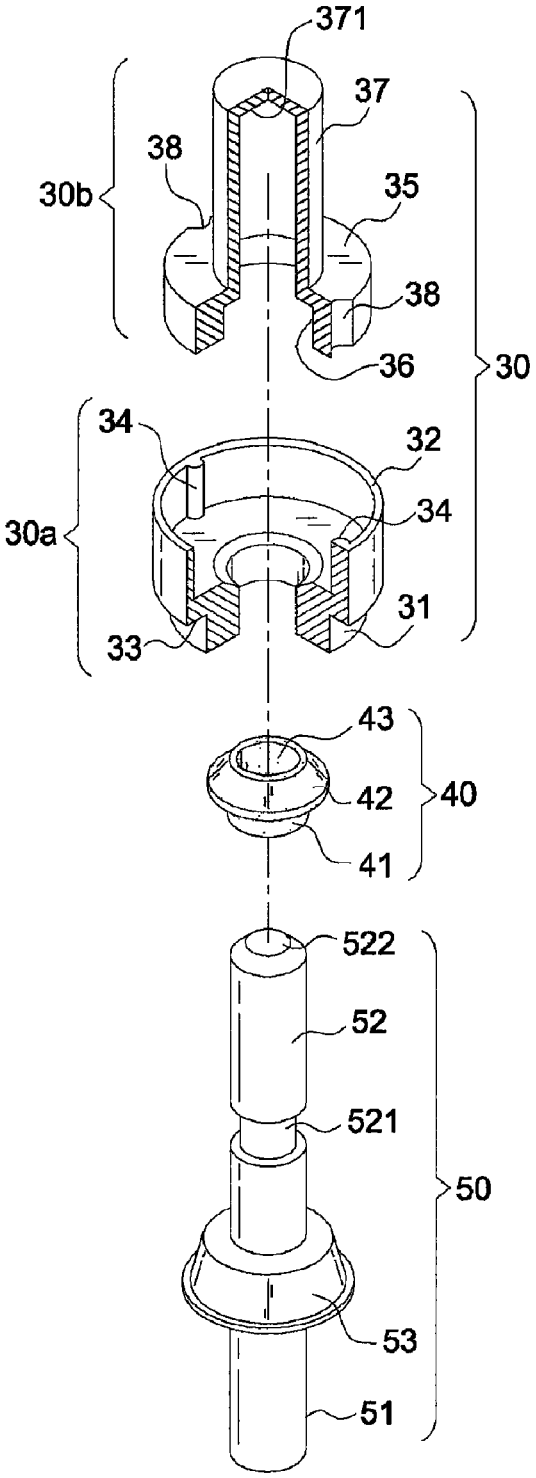
FIGS. 3A and 3B are the perspective views showing the assembly of the support shaft and the positioning element of the invention.
Figure 3B:
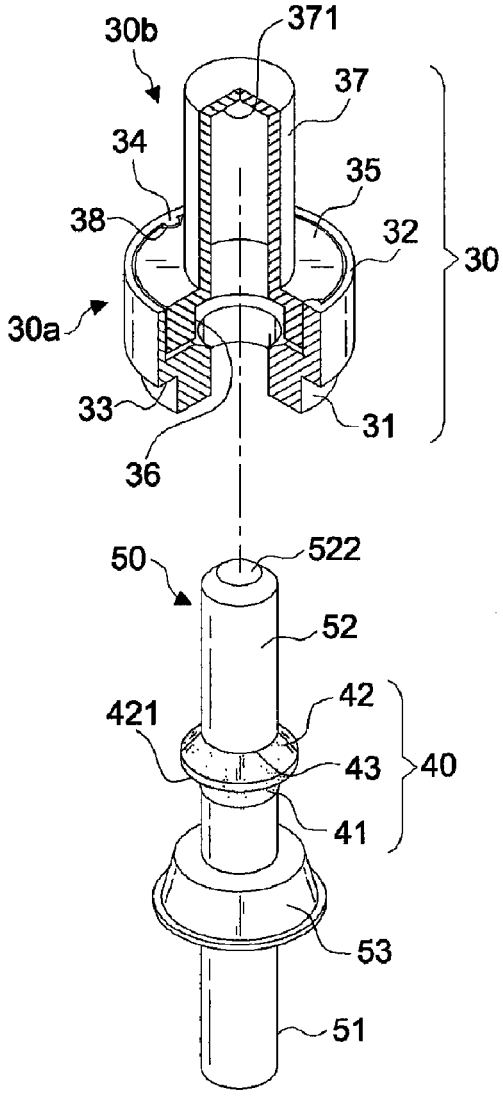
Figure 4A:
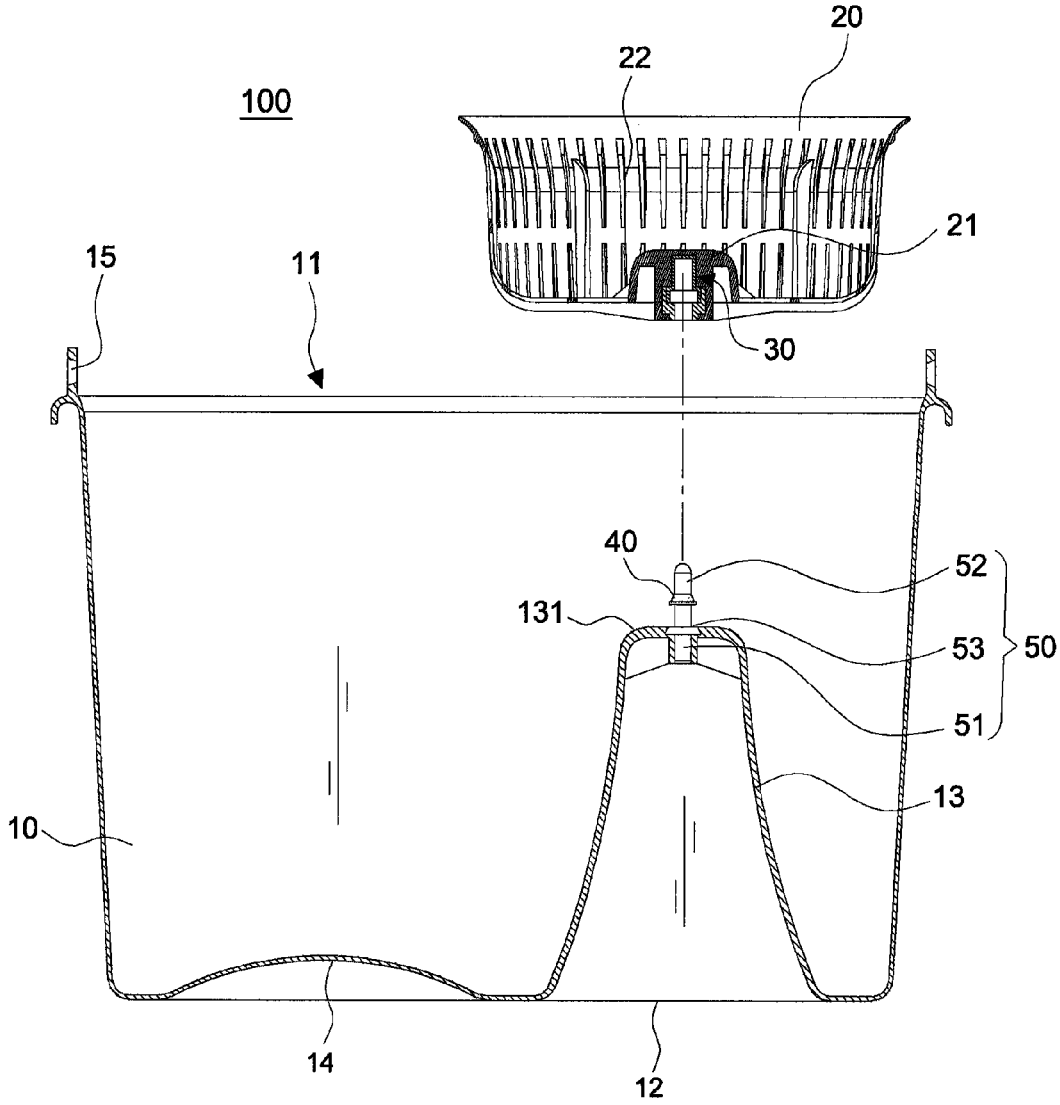
FIG. 4A is an exploded view of a wringer bucket in accordance with the invention.
Figure 4B:
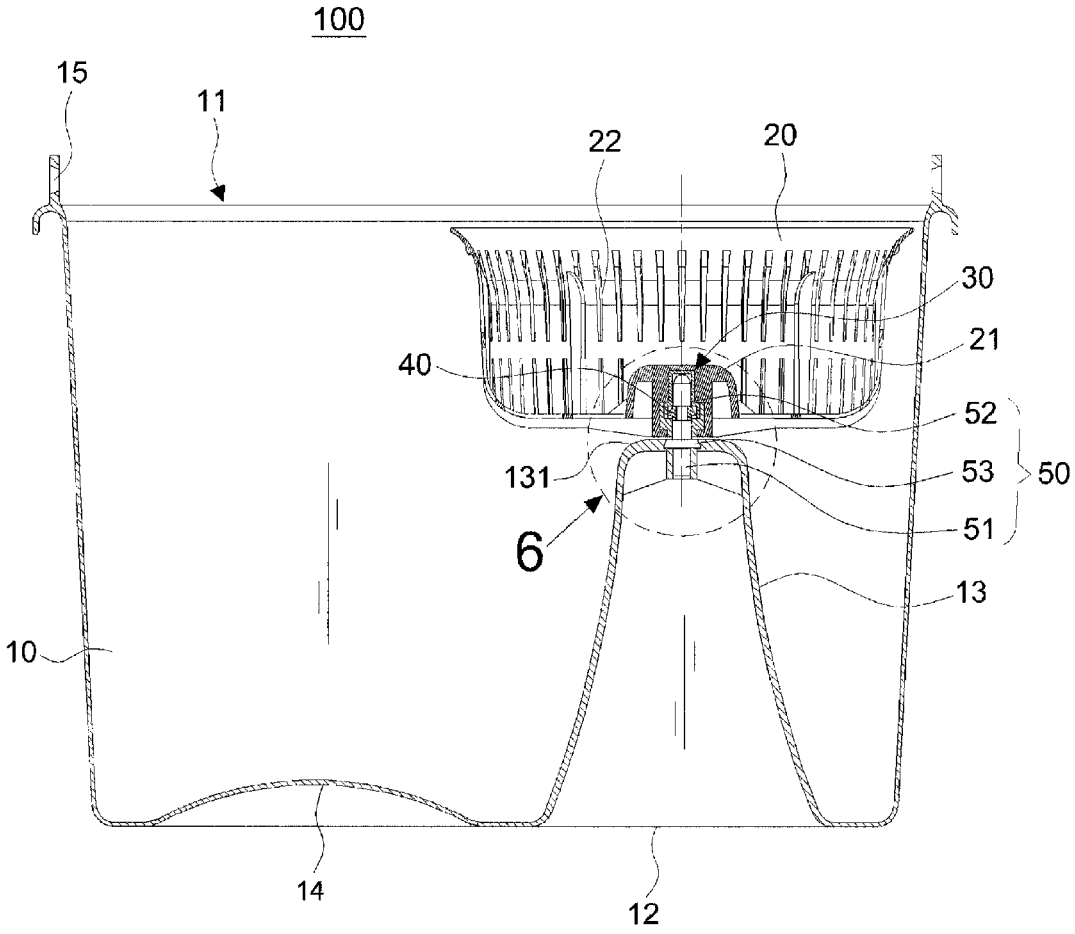
FIG. 4B is a cross-sectional assembly view of a wringer bucket in accordance with the invention.

First of all, referring to FIGS. 1 through 6, a wringer bucket 100 in accordance with the invention includes a bucket body 10, a dewatering basket 20, a shaft holder 30, a support shaft 50, and a positioning element 40. The bucket body 10 includes an opening 11 at the top thereof. A projecting seat 13 is extended from the bottom 12 of the bucket body 10 toward inside. The upright support shaft 50 is supported on the projecting seat 13. The dewatering basket 20 is provided with a plurality of dewatering holes 22 at the periphery and the bottom thereof.

Figure 10:
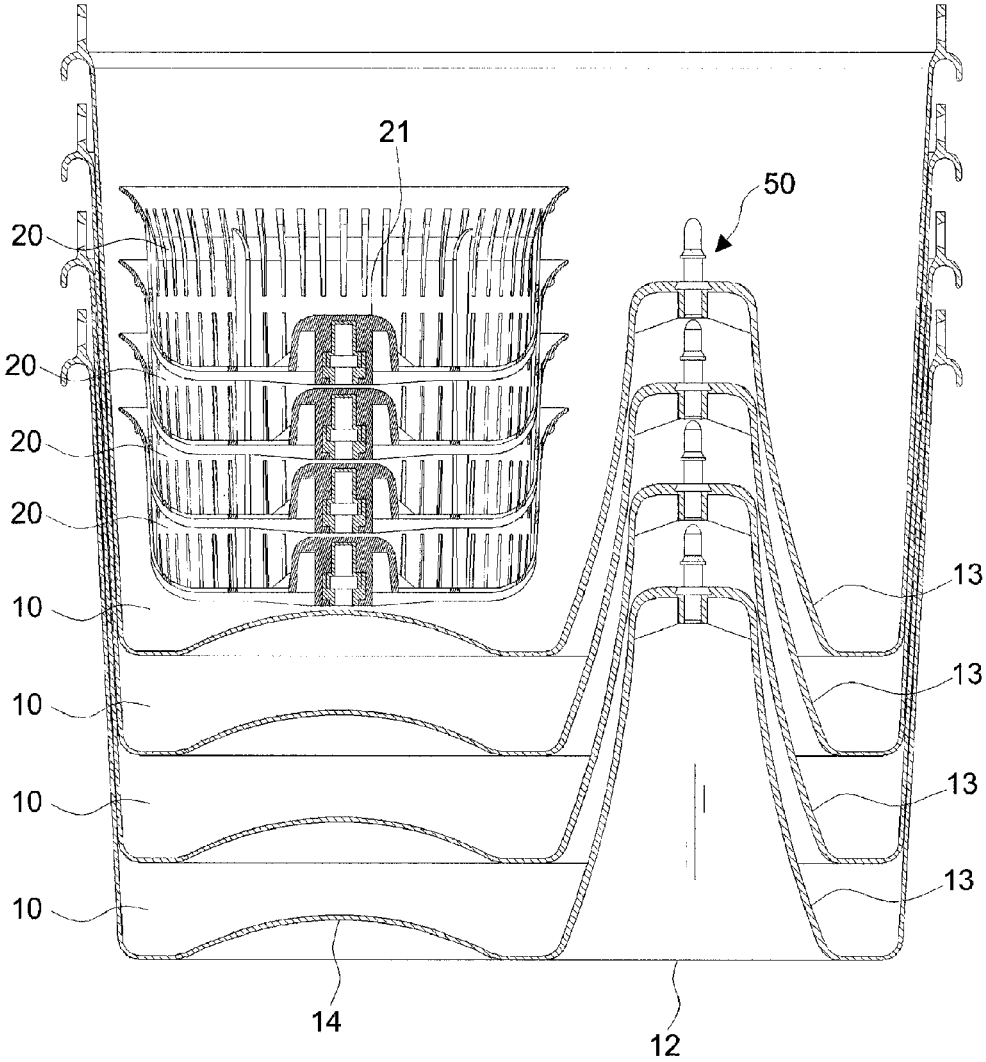
FIG. 10 is a schematic drawing of bucket bodies and dewatering baskets that are separately stacked on each other.

The height of the projecting seat 13 depends on the actual depth of the bucket. Preferably, the projecting seat 13 should be higher than or equal to the horizontal surface of the required amount of water within the bucket body 10. The support shaft 50 can be engaged into the projecting seat 13 (see FIG. 4A). The top 131 of the projecting seat 13 is flat. As shown in FIG. 10, the bottom 12 of the projecting seat 13 has a ⎍ -shaped section such that the projecting seats 13 may be stably stacked on each other.

As shown in FIGS. 3A, 3B, 4A, and 4B, the lower portion 51 of the support shaft 50 is covered and secured by the projecting seat 13 while the upper portion thereof juts out of from the top 131 of the projecting seat 13 to create a connection part 52. A recessed part 521 is formed at the center of the connection part 52.

The positioning element 40 is made of elastic or flexible material. The main body 41 of the positioning element 40 includes a conic part 42 at the top thereof. The conic part 42 is tapered upward. The center of the positioning element 40 includes a shaft hole 43 with an internal diameter corresponding to the external diameter of the recessed part 521 such that the positioning element 40 fits into the recessed part 521. Meanwhile, a positioning surface 421 is formed at the bottom of the conic part 42 and extended outward from the periphery of the support shaft 50. In other words, the positioning element 40 after expansion tends to engage into the recessed part 521 by use of the material flexibility without loosening therefrom. According to the embodiment, the positioning element 40 is made of rubber, but the material should not be limited thereto.

The dewatering basket 20 is formed by a plastic injection molding process and includes a driven seat 21 at the center of the bottom thereof. During the formation of the driven seat 21, the center of the bottom of the driven seat 21 encloses a shaft holder 30 with an opening directed downward and made of non-metal material. As shown in FIGS. 3A, 3B, 5, and 6, the shaft holder 30 consists of a lower sleeve 30*a* and an upper sleeve 30*b* engaging into the lower sleeve 30*a*. An engagement groove 36 having a larger diameter is formed within the central portion of the shaft holder 30. An end stop 371 is positioned within the top of the upper sleeve 30*b*. Accordingly, the driven seat 21 tends to slip from top to bottom over the connection part 52 of the support shaft 50. After the lower sleeve 30*a* passes through positioning element 40 in a compression manner, the positioning surface 421 of the positioning element 40 is stretched into the engagement groove 36 when returning to its original shape. In this way, the dewatering basket 20 can be protected from loosening from the support shaft 50 when rotated thereon. Moreover, the end stop 371 of the upper sleeve 30*b* lies against the top portion 522 of the support shaft 50, thus creating a rotating center. Thus, the whole contact point of the dewatering basket 20 is concentrated at the rotating center, thereby reducing the frictional resistance between the shaft holder 30 and the support shaft 50 and therefore permitting a smooth rotation.

According to a preferred embodiment, the above-mentioned shaft holder 30 is made of reinforced plastics. The lower sleeve 30*a* includes a lower mounting portion 31 and a first cover ring 32 attached to the top of the lower mounting portion 31. The first cover ring 32 with an opening directed upward has a larger internal diameter such that a stepped surface 33 is created between the bottom of the first cover ring 32 and the periphery of the lower mounting portion 31.

The upper sleeve 30*b* includes an upper mounting portion 37 with an opening directed downward and a closed end stop positioned at the top thereof. A second cover ring 35 is attached to the bottom of the upper mounting portion 37. The second cover ring 35 with an opening directed downward has a larger internal diameter. The second cover ring 35 fits into the first cover ring 32 to form an integral body. Meanwhile, an engagement groove 36 having a larger diameter than the internal diameter of the upper sleeve 30*b* and the lower sleeve 30*a* is created therebetween.

Furthermore, at least one convex rib 34 is axially extended at the internal circumference of the first cover ring 32 while the periphery of the second cover ring 35 is provided with axial slots 38 that are so dimensioned that a tight fit of the convex ribs 34 in the axial slots 38 is achieved. In this way, the first cover ring 32 and the second cover ring 35 are tightly secured to each other.

Moreover, the feature of the invention lies in that the dewatering basket 20 is separated from the bucket body 10 before leaving the factory (see FIG. 10) such that the dewatering baskets 20 and the bucket bodies 10 may be separately stacked to each other to permit a convenient storage and transportation. Meanwhile, it is very easy for the consumers to assemble them (by themselves) by means that the driven seat 21 of the dewatering basket 20 is mounted from top to bottom on the connection part 52 of the support shaft 50. The internal diameter of the shaft holder 30 corresponds substantially to the external diameter of the support shaft 50, but is smaller than that of the positioning surface 421 of the conic part 42 of the positioning element 40. The conic part 42 is conically and flexibly formed such that the lower sleeve 30*a* of the shaft holder 30 may slip over the inclined plane of the conic part 42 and pass through the positioning element 40 in a compression way. After the positioning element 40 returns to its original shape upon removal of the compression force, the positioning surface 421 is stretched into the engagement groove 36 within the shaft holder 30. In this way, it is easy to attach the dewatering basket 20 to the support shaft 50. Moreover, the dewatering basket 20 is not easily detached from the positioning surface 421 due to the locking action done by the positioning surface 421 when rotated. As a result, a safe use and a tight fit are ensured. Besides, the shaft holder 30 is integrally disposed within the driven seat 21 so that it is not possible that the shaft holder 30 is loosened therefrom. What is more important is that the shaft holder 30 is specially designed (with respect to the conventional bearing in the market) to permit a tight and smooth fit of the positioning element 40 (positioned on the support shaft 50) into the engagement groove 36. In addition, the end stop 371 is in contact with the top portion 522 of the support shaft 50 when the dewatering basket 20 is in operation. As a result, the frictional resistance is very slight. Moreover, the shaft holder 30 is made of non-metal material so that it won't rust. Thus, the service life may be prolonged and a smooth operation is achieved.

Figure 5:
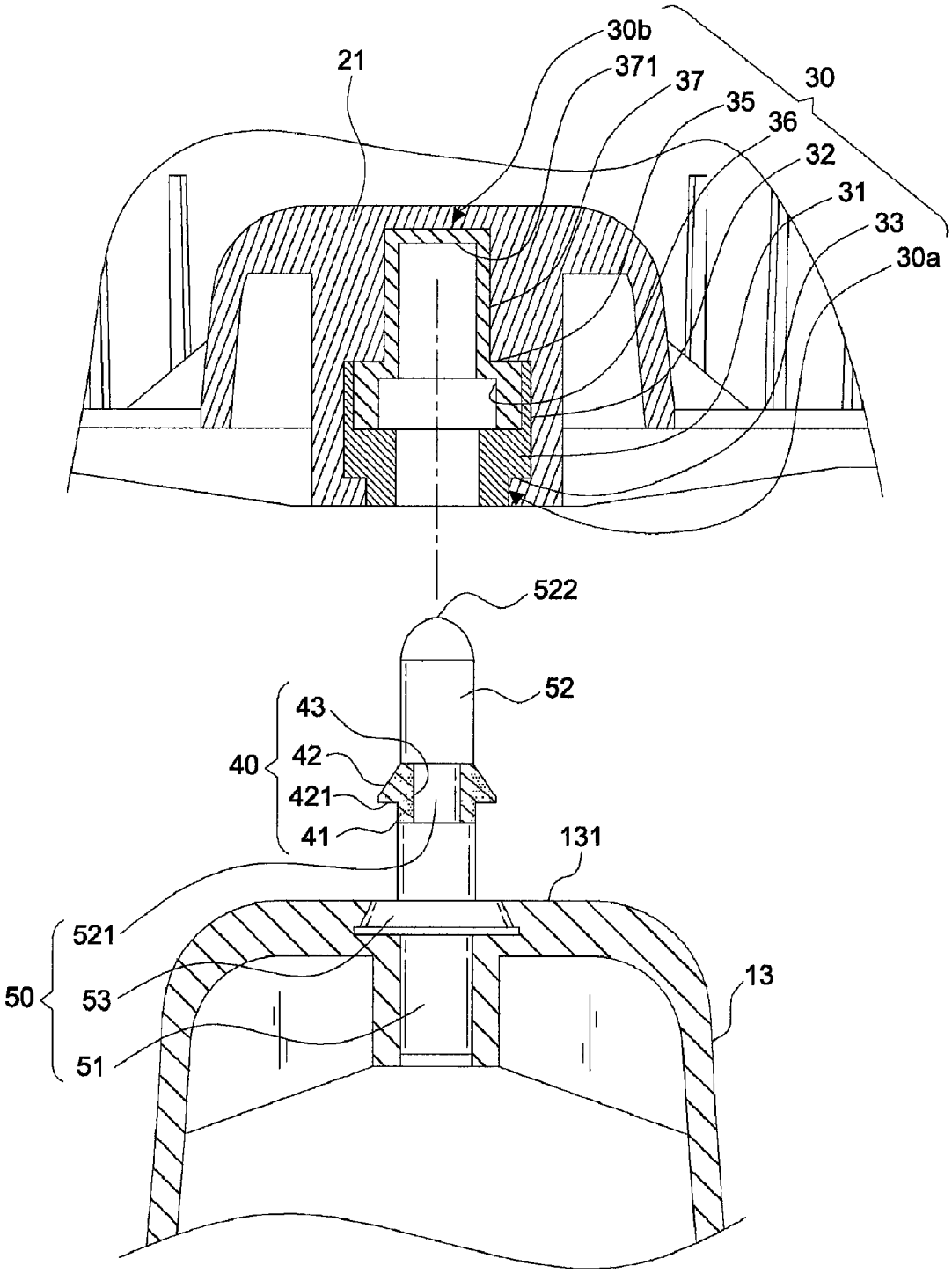
FIG. 5 is an enlarged section from FIG. 4A.
Figure 6:
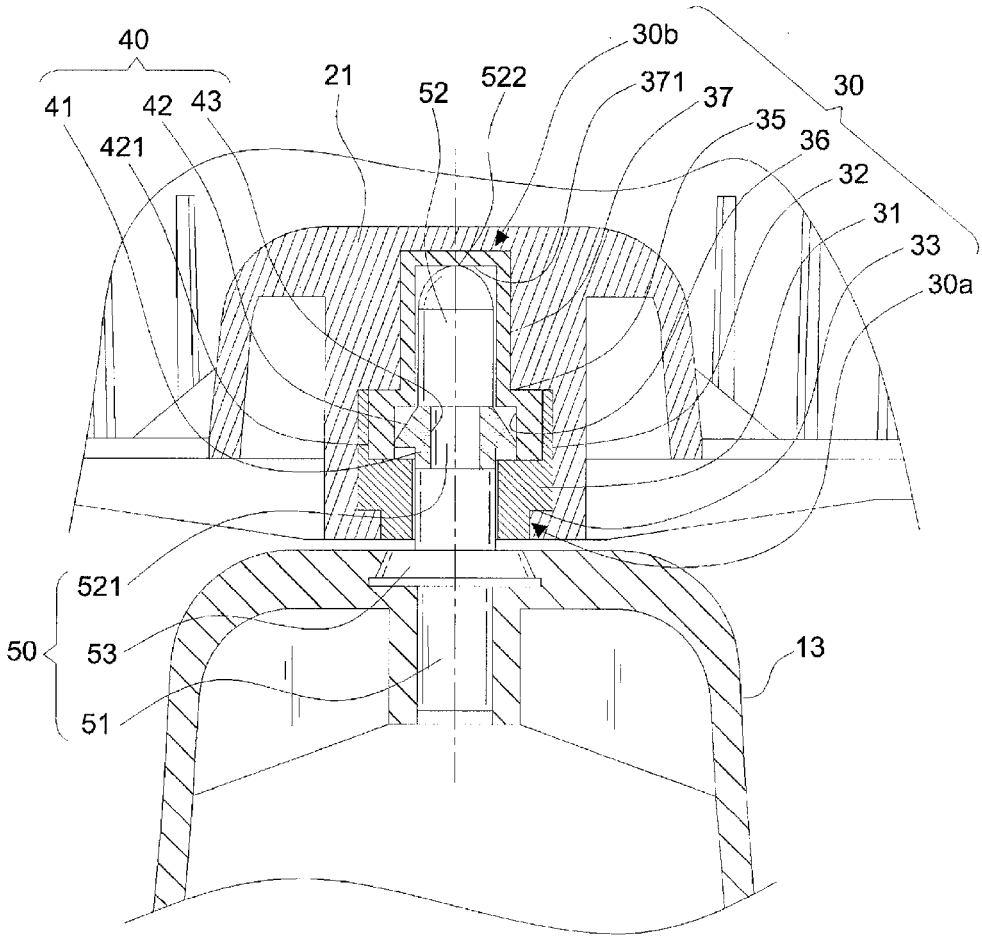
FIG. 6 is an enlarged section 6 from FIG. 4B.

As shown in FIGS. 5 and 6, a conic protrusion ring 53 is positioned at the center of the support shaft 50. The lower part of the conic protrusion ring 53 is disposed within the projecting seat 13 while the upper part thereof is exposed at the top 131 of the projecting seat 13 such that the shaft holder 30 lies against it for a smooth rotation. The conic protrusion ring 53 is designed to prevent the support shaft 50 from an undesirable detachment from the projecting seat 13.

Figure 7:
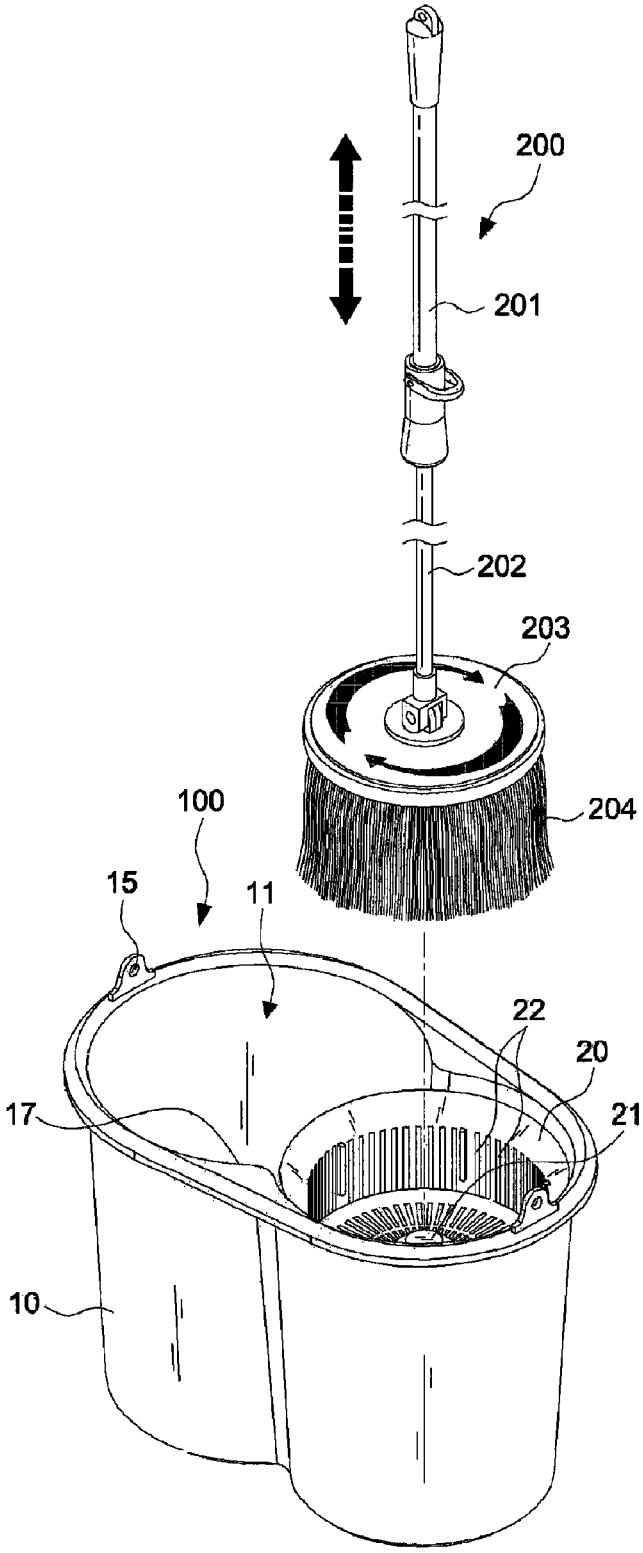
FIG. 7 is a perspective view of the wringer bucket of the invention before a mop is placed therein for dewatering.
Figure 8:
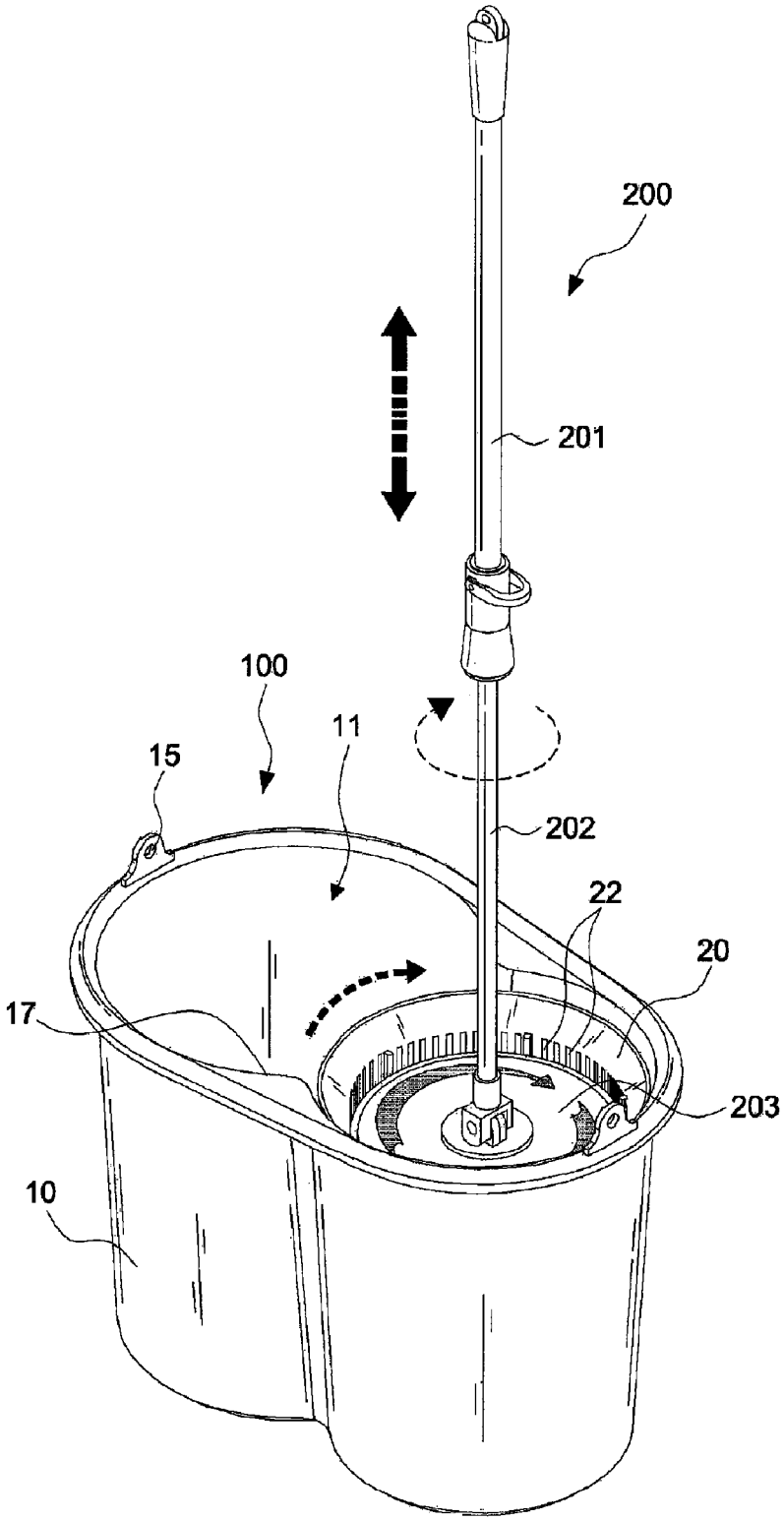
FIG. 8 is a perspective view of the wringer bucket of the invention with a mop placed therein for dewatering.

FIGS. 7 and 8 show the operation of a mop 200 by use of the wringer bucket of the invention. The mop 200 includes an external rod 201, an internal rod 202, a mop head 203 attached to the bottom of the internal rod 202, and mop yarns 204. In dewatering the mop yarns 204, the mop head 203 and the mop yarns 204 are placed within the dewatering basket 20. The internal rod 202 is rotated by operating the external rod 201 with the hands of the operator such that the mop head 203 and the mop yarns 204 are synchronically moved. At that time, the dewatering basket 20 in a load-free state tends to be driven. The bottom of the dewatering basket 20 is provided with the above-mentioned shaft holder 30 so that a very smooth rotation is achieved. In this way, the water within the mop yarns 204 will be thrown away through the dewatering holes 22 by the centrifugal force.

As shown in FIG. 8, the bucket body 10 includes an opening 11 with an 8-shaped contour. Two tapered portions 17 are positioned at both sides of the central portion of the wringer bucket 100. In dewatering the mop 200, the water within the mop yarns 204 will be thrown away in the tangent direction by the centrifugal force. Meanwhile, the thrown-away water drops tend to be in contact with the tapered portions 17 at the central portion of the opening 11 and to move downward along the internal wall of the bucket body 10. The tapered portions 17 are designed for protecting the water drops from being sprayed away, thereby wetting the operator or the ground.

Figure 9:
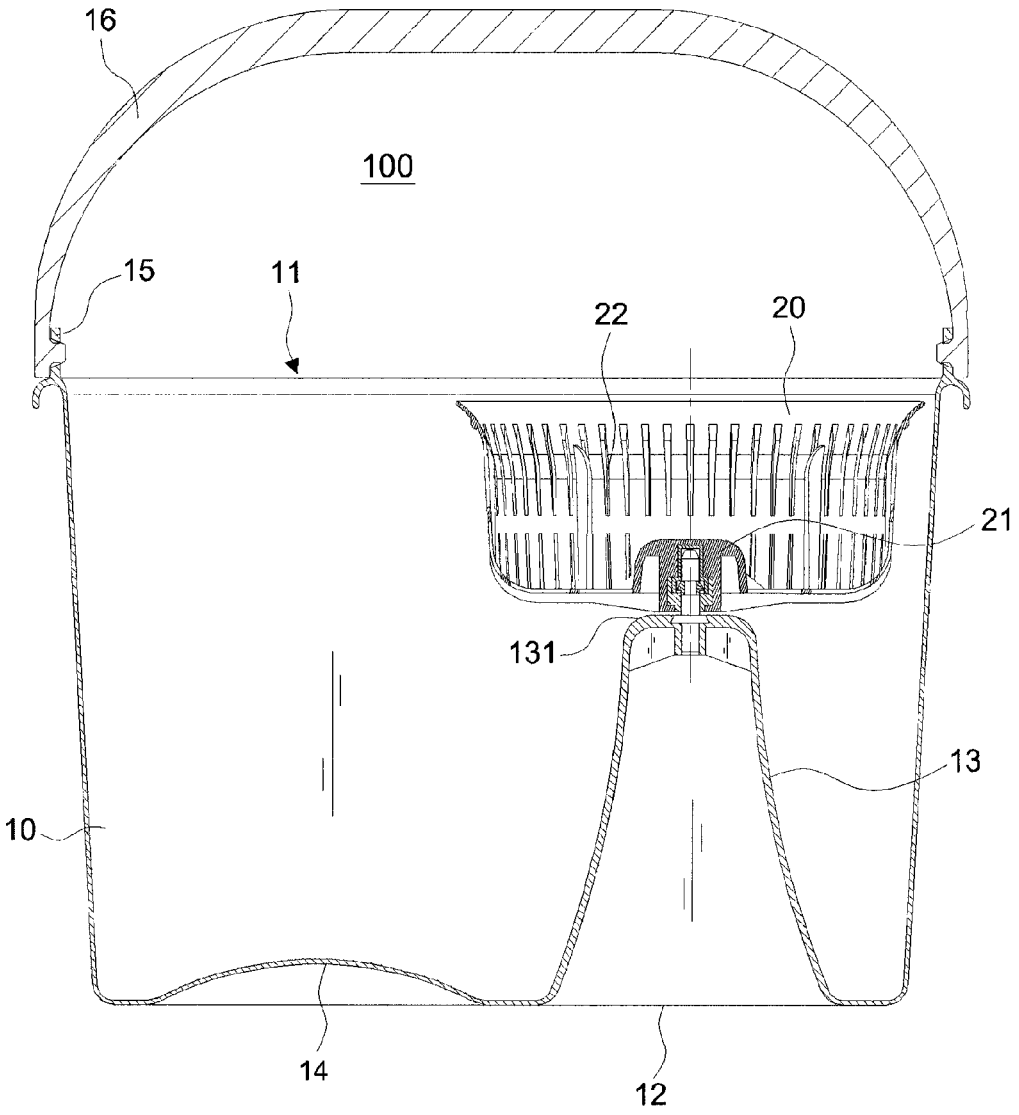
FIG. 9 is a schematic drawing of the wringer bucket of the invention with a handle.

As shown in FIG. 9, the bucket body 10 of the wringer bucket 100 in accordance with the invention includes further a pair of projecting ears 15 for connecting a handle 16. It is convenient for the operator to carry the bucket body 10 with the handle 16. Moreover, a bulging-out portion 14 is positioned at the bottom 12 of the bucket body 10 for enhancing the supporting force of the bucket body 10. In this way, the rocking action of the wringer bucket 100 will be avoided when the shaft holder 30 is rotated.

By use of the operation of the wringer bucket 100 of the invention, it is not necessary to tread with feet in dewatering the mop. Accordingly, the risk in using the wringer bucket 100 is reduced for the elderly operators.

In addition, the lower portion 51 of the support shaft 50 of the invention is tightly fixed within the projecting seat 13. In other words, it is not rotated therein. As a result, the water within the bucket body 10 does not leak from the support shaft 50.

According to the wringer bucket of the invention, the dewatering basket 20 is mounted on the shaft holder 30 for a free rotation. The designed structure is very simple. The wearing action may be minimized even for the long-term use. Moreover, the bucket body 10 and the dewatering basket 20 may be stacked on each other when leaving from the factory rather than delivering the assembled (finished) product (see FIG. 10). In other words, the easy assembly may be done by the operators themselves. This reduces not only the financial burden for the operators, but also the production cost for the manufacturers. Besides, the dewatering basket 20 after DIY-assembly (do-it-yourself) won't be loosened by means of the pre-mounted positioning element, thus ensuring the safety in use. Accordingly, the wringer bucket of the invention is beneficial both to the manufactures and to the operators.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A free-of-bearing rotational positioning device for a dewatering basket of a non-treading type wringer bucket, comprising:

a) a bucket body having an opening at the top thereof, a projecting seat being extended from the bottom of the bucket body toward inside;

b) a support shaft made of metal material, the lower portion of the support shaft being covered and secured by the projecting seat, the upper portion thereof jutting out of the top of the projecting seat to create a connection part, a recessed part being formed at the center of the connection part;

c) a positioning element made of elastic/flexible material, the main body of the positioning element having a conic part at the top thereof, the conic part being tapered upward, the center of the positioning element having a shaft hole with an internal diameter corresponding to the external diameter of the recessed part such that the positioning element fits into the recessed part of the support shaft, a positioning surface being formed at the bottom of the conic part and extended outward from the periphery of the support shaft; and d) a dewatering basket formed by a plastic injection molding process and having a plurality of dewatering holes at the periphery and the bottom thereof, the dewatering basket further having a driven seat at the center of the bottom thereof, wherein, during the formation of the driven seat, the center of the bottom of the driven seat encloses a shaft holder with an opening directed downward and made of non-metal material, and the shaft holder consists of a lower sleeve and an upper sleeve engaging into the lower sleeve, and an engagement groove having a larger diameter is formed within the central portion of the shaft holder, and an end stop is positioned within the top of the upper sleeve, whereby the driven seat tends to slip from top to bottom over the connection part of the support shaft, and after the lower sleeve passes through positioning element in a compression manner, the positioning surface of the positioning element is stretched into the engagement groove when returning to its original shape; in this way, the dewatering basket can be protected from loosening from the support shaft when rotated thereon; moreover, the end stop of the upper sleeve lies against the top portion of the support shaft, thus creating a rotating center; thus, the whole contact point of the dewatering basket is concentrated at the rotating center, thereby reducing the frictional resistance between the shaft holder and the support shaft and therefore permitting a smooth rotation.

2. The free-of-bearing rotational positioning device for a dewatering basket of a non-treading type wringer bucket as recited in claim 1 wherein the lower sleeve and the upper sleeve are made of a reinforced plastics, wherein the lower sleeve includes a lower mounting portion and a first cover ring attached to the top of the lower mounting portion, and the first cover ring with an opening directed upward has a larger internal diameter such that a stepped surface is created between the bottom of the first cover ring and the periphery of the lower mounting portion; and wherein the upper sleeve includes an upper mounting portion with an opening directed downward and an closed end stop positioned at the top thereof, and a second cover ring is attached to the bottom of the upper mounting portion, and the second cover ring with an opening directed downward has a larger internal diameter, and the second cover ring fits into the first cover ring to form an integral body; meanwhile, an engagement groove having a larger diameter than the internal diameter of the upper sleeve and the lower sleeve is created therebetween.

3. The free-of-bearing rotational positioning device for a dewatering basket of a non-treading type wringer bucket as recited in claim 2 wherein at least one convex rib is axially extended at the internal circumference of the first cover ring while the periphery of the second cover ring is provided with axial slots that are so dimensioned that a tight fit of the convex ribs in the axial slots is achieved; in this way, the first cover ring and the second cover ring are tightly secured to each other.

4. The free-of-bearing rotational positioning device for a dewatering basket of a non-treading type wringer bucket as recited in claim 1 wherein a conic protrusion ring is positioned at the center of the support shaft, and the lower part of the conic protrusion ring is disposed within the projecting seat while the upper part thereof is exposed at the top of the projecting seat.

5. The free-of-bearing rotational positioning device for a dewatering basket of a non-treading type wringer bucket as recited in claim 1 wherein the positioning element is made of plastic material.

6. The free-of-bearing rotational positioning device for a dewatering basket of a non-treading type wringer bucket as recited in claim 1 wherein the driven seat bulges out the center of the bottom within the dewatering basket.

7. The free-of-bearing rotational positioning device for a dewatering basket of a non-treading type wringer bucket as recited in claim 1 wherein the bucket body includes an opening with an 8-shaped contour, and two tapered portions are positioned at both sides of the central portion of the wringer bucket.

8. The free-of-bearing rotational positioning device for a dewatering basket of a non-treading type wringer bucket as recited in claim 1 wherein a bulging-out portion is positioned at the bottom of the bucket body for enhancing the supporting force of the bucket body.

9. The free-of-bearing rotational positioning device for a dewatering basket of a non-treading type wringer bucket as recited in claim 1 wherein the bucket body includes further a pair of projecting ears for connecting a handle.

10. The free-of-bearing rotational positioning device for a dewatering basket of a non-treading type wringer bucket as recited in claim 1 wherein the bottom of the projecting seat has a ⎍ -shaped section such that the projecting seats may be stably stacked on each other.

* * * * *